United States Patent [19]

Shirey

[11] 3,977,073

[45] Aug. 31, 1976

[54] METHOD OF MAKING ELECTRIC IMMERSION HEATERS

[75] Inventor: Robert D. Shirey, Pittsburgh, Pa.

[73] Assignee: Emerson Electric Co., St. Louis, Mo.

[22] Filed: Aug. 11, 1975

[21] Appl. No.: 603,346

[52] U.S. Cl. ..... 29/611; 204/33; 219/316; 219/335; 427/123; 427/328; 427/405; 427/436

[51] Int. Cl.[2] ..... H05B 3/10; H05B 3/82

[58] Field of Search ..... 29/611, 613, 614, 615, 29/197; 219/316, 318, 335, 336; 338/317; 427/123, 309, 328, 405, 436; 204/33

[56] References Cited

UNITED STATES PATENTS

| | | | |
|---|---|---|---|
| 2,377,606 | 6/1945 | Blackmun et al. | 427/436 |
| 2,670,529 | 3/1954 | Thomas | 29/614 |
| 2,785,270 | 3/1957 | Burger | 29/614 X |
| 2,947,639 | 8/1960 | Balden | 427/436 |
| 3,108,006 | 10/1963 | Kenedi et al. | 204/33 X |
| 3,455,014 | 7/1969 | Beyer | 204/40 X |
| 3,778,592 | 12/1973 | Williams | 219/336 |
| 3,881,999 | 5/1975 | Toth et al. | 29/197 X |

*Primary Examiner*—Victor A. DiPalma
*Attorney, Agent, or Firm*—Michael Williams

[57] ABSTRACT

The method of providing a corrosion-resistant coating on the aluminum sheath of an electric immersion heater, comprising the steps of treating the sheath with a nitric acid solution to put a uniform layer of oxide on the exterior sheath surface, then treating the sheath with a caustic tin-bearing solution to strip all oxide from said exterior surface and replace it with a uniform layer of tin, then depositing a uniform layer of bronze over the tin layer, and finally depositing a layer of tin over the bronze coating.

3 Claims, 3 Drawing Figures

METHOD OF MAKING ELECTRIC IMMERSION HEATERS

BACKGROUND AND SUMMARY

Electric immersion heaters are manufactured in many forms for use in heating various liquids. All immersion heaters have a tubular metal sheath in which a heating resistor coil is disposed, the coil being electrically insulated from the sheath by compacted refractory material which also serves to conduct the heat from the coil to the sheath.

The opposite ends of the resistor coil are mechanially and electrically secured to terminal pins which extend through insulator bushings in the opposite ends of the sheath for connection to a source of electrical energy. The opposite ends of the sheath are mechanically connected to a support which may take the form of a flange mounting plate, a screw plug, a junction box and the like.

A common type of immersion heater is used for heating water in a hot water tank in houses for the supply of hot water. This type of heater may take the form shown in U.S. Pat. Nos. 3,217,138; 3,585,359; and 3,778,592, all assigned to the assignee of the present invention, and comprises a flat metal flange having a pair of holes through which the opposite ends of a hairpin sheath are disposed. The opposite sheath ends are firmly connected to the plate by welding, brazing or staking.

Other forms of immersion heaters are disclosed in the Industrial Stock Catalog entitled "Chromalox" and distributed by the Edwin L. Wiegand Division of Emerson Electric Co. Included in these other forms are screw-plug type elements, having either a hair-pin sheath or a cartridge-type sheath; heater for coffee urns and the like; over-the-side heaters; circulation heaters; and the like.

It has heretofore been customary to form the sheath of the immersion heaters of relatively expensive copper, stainless steel, Incoloy or other suitable metals, to resist the corrosive action of the liquid in which the sheath of the immersion heater is immersed.

In the case of the usual heater for a hot water tank, the sheath is commonly made of copper or copper alloy. To prolong the life of the magnesium anode rod commonly installed in hot water tanks, the copper sheath is tin-plated, and this represented a further expense.

It has heretofore been proposed to form the sheath of an immersion heater of aluminum because of the relatively lower cost of this material and the ease with which it may be worked. However, aluminum has a tendency to hydrate when immersed in water, and to build what is commonly termed as "sores," namely, white spots which build up and spall off until a hole is eventually formed in the sheath and this, of course, results in failure of the heating element.

Tests have also been conducted wherein the aluminum sheath was tin-plated, but although this was an improvement, these methods of putting tin on aluminum used an intermediate layer of zinc which was attacked and dissolved by galvanic action, which in turn caused the tin coating to blister and fall off. I have discovered that if an adherent base is applied to the aluminum sheath, the tin-plate may thereafter be applied to the sheath to completely cover all exposed surfaces thereof. The adherent base found suitable is a strike in the form of an extremely thin coating of bronze or copper. Prior to this invention, it was not possible to produce a satisfactory immersion heater for heating liquids, such as water, utilizing an aluminum sheath, but this has now been overcome through use of this invention.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
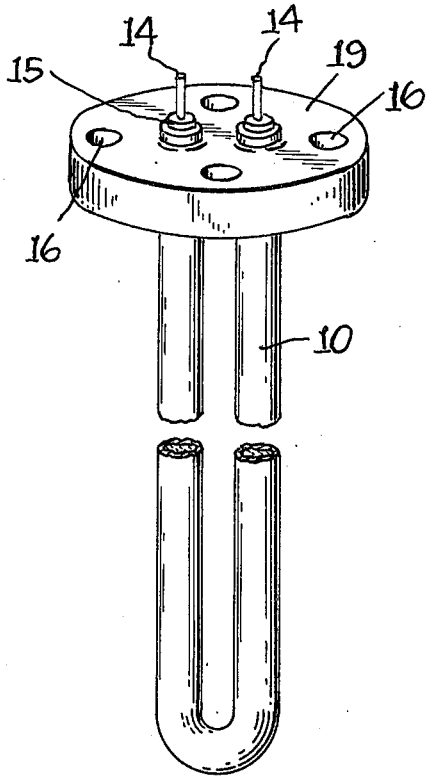
FIG. 1 is a fragmentary perspective view of one type of immersion heater to which my invention may be applied.
Figure 2:
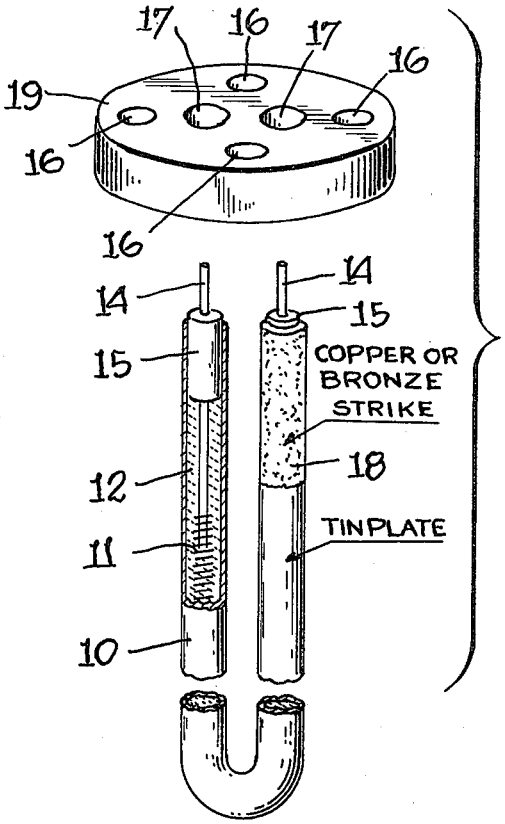
FIG. 2 is a fragmentary perspective view similar to FIG. 1, but with parts in disassembled relation.

FIGS. 1 and 2 disclose a conventional water heater comprising a tubular sheath 10 having a coiled resistance wire 11 embedded in compacted refractory material 12. The sheath is U-shaped to form the so-called hairpin type heater. Opposite ends of the heater coil are mechanically and electrically connected to respective terminal pins 14 which extend outwardly of the sheath for connection to a source of electrical energy. Insulating bushings 15 are firmly held within the ends of the sheath to close the same, and the terminal pins extend through respective bushings.

Usually, the mounting flange 19 is formed as a steel stamping and may be round as shown, or square, with holes 16 at its periphery to pass bolts (not shown) to secure the flange to a bushing carried by the wall of the hot water tank. The flange 19 also has a pair of holes 17 to pass respective ends of the sheath, and such ends are firmly held to the flange as by staking operation.

In accordance with my invention, the sheath 10 is formed of aluminum or an aluminum alloy, and an adherent base coat (shown by the stipling 18 in FIG. 2) is applied to the sheath after the latter has been precleaned. The base coat is preferably a bronze or copper strike, and subsequently a tin or nickel plate is applied over the strike.

Although the fully assembled heater shown in FIG. 1 may be treated, it is preferable to proceed in accordance with the following steps: The electric heater is made according to usual procedures wherein a straight tubular sheath is produced with coiled resistance wire, refractory material, terminal pins and bushing or bushings therein, and subjected to rolling or side pressing to compact the refractory material and lock the bushings in place. If the heater is to be of the hairpin type, the sheath is bent to the U-shape shown in FIG. 2.

Figure 3:
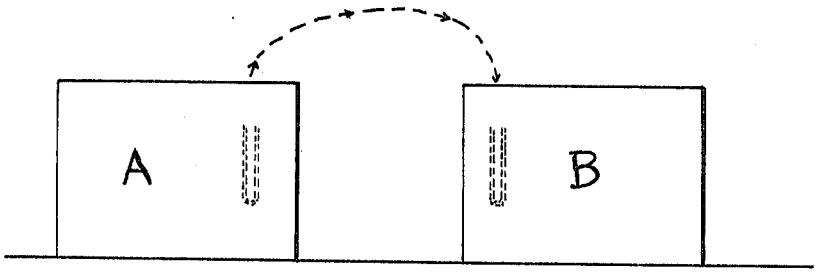
FIG. 3 is a schematic illustration of treating tanks.

The heater thus far produced is precleaned and or degreased to remove any oxide from the sheath exterior. Usually, this oxide is of non-uniform character and its removal is preferable. The sheath is then dipped in a nitric acid bath A (FIG. 3) for a predetermined amount of time (about 30 seconds is satisfactory in many cases). The nitric acid dip puts a uniform layer of aluminum oxide on the sheath surface and it has been determined that such uniform layer of oxide is preferable for subsequent steps in the process.

After a water rise, the sheath is dipped into a bath B (FIG. 3) containing a highly caustic tin-bearing solution, such as potassium stannate solution for about 6 minutes to strip all oxide from the sheath and in its place deposit a uniform layer of tin thereon.

After a further water rinse, a thin uniform layer of bronze or copper (called a strike because of the thinness of the layer) is plated over the uniform layer of tin, and a final layer of tin or nickel is subsequently plated over the bronze or copper strike.

It has been determined that the foregoing procedure provides a final tin or nickel layer on the aluminum sheath that is free of all voids and therefore overcomes the difficulties of tin plating over aluminum in the methods heretofore utilized.

After the final plating of the sheath, the latter is assembled with the mounting flange 19, it being understood that the flange has been previously given a tin plate coating. If desired, the mounting flange may be made of the same material as the sheath, in which case it may be assembled with the sheath and then treated with the latter.

Reference is made to a commercially available aluminum treating process disclosed in literature distributed by M & T Chemical Inc., a subsidiary of American Can Company. In such literature, the process is designated as the "Alstan 70 Process" or the "Alstan 80 Process". Literature relating to the "Alstan 70 Process" refers to U.S. Pat. No. 3,274,021, which is titled "Stannate Coating Bath and Method of Coating Aluminum with Tin."

I claim:

1. The method of making an electric immersion heater having a sheath formed of aluminum tubing, said sheath having one end connected to a mounting member, comprising the usual steps of assembling a resistor coil, refractory material, end bushing means and terminal pins within said sheath, the improvement to increase resistance of said sheath to corrosive action, comprising:

replacing the oxide on the exterior surface of said sheath with a tin coating, applying a adherent coating of bronze over said tin coating, and thereafter applying a coating of tin over said adherent coating.

2. The method according to claim 1 wherein said sheath is precleaned to remove oxide from its exterior surface, then dipped in a nitric acid solution to put a uniform layer of oxide on said exterior surface; then dipped in a caustic tin-bearing solution to strip all oxide from said exterior surface and replace it with a uniform coating of thin; then depositing a uniform layer of bronze over said tin coating; and finally depositing a coating of tin over said bronze coating.

3. The method according to claim 1 wherein said mounting member is formed of steel and has a tin-plate coating, wherein said sheath exterior surface is treated as specified and is thereafter assembled with said mounting member.

* * * * *

UNITED STATES PATENT OFFICE

CERTIFICATE OF CORRECTION

PATENT NO. : 3 977 073

DATED : August 31, 1976

INVENTOR(S) : Robert D. Shirey

It is certified that error appears in the above-identified patent and that said Letters Patent are hereby corrected as shown below:

Column 2, line 38, after "by" insert- - - a- - - - .

Column 4, line 21, "thin" should be - - - -tin- - -.

Signed and Sealed this

Second Day of November 1976

[SEAL]

*Attest:*

RUTH C. MASON
*Attesting Officer*

C. MARSHALL DANN
*Commissioner of Patents and Trademarks*